US005918304A

United States Patent [19]

Gartz

[11] Patent Number: 5,918,304

[45] Date of Patent: Jun. 29, 1999

[54] APPARATUS FOR MONITORING THE FIRING STRESS OF A WEAPON BARREL

[75] Inventor: Karl Gartz, Neuss, Germany

[73] Assignee: Rheinmetall Industrie AG, Ratingen, Germany

[21] Appl. No.: 08/934,193

[22] Filed: Sep. 19, 1997

[30] Foreign Application Priority Data

Sep. 20, 1996 [DE] Germany ..... 196 38 576

[51] Int. Cl.[6] ..... B64D 1/04; F41A 9/53

[52] U.S. Cl. ..... 89/1.1; 42/1.01; 73/167

[58] Field of Search ..... 89/1.1; 42/1.01, 42/106; 73/167

[56] References Cited

U.S. PATENT DOCUMENTS

| | | | |
|---|---|---|---|
| 3,552,053 | 1/1971 | Jarvis . | |
| 3,902,368 | 9/1975 | Hasenbein et al. | 42/1.01 |
| 3,914,996 | 10/1975 | Davis et al. | 42/1.01 |
| 4,263,807 | 4/1981 | Brown et al. | 73/167 |
| 5,349,853 | 9/1994 | Oehler | 42/1.01 |
| 5,402,678 | 4/1995 | Fritz et al. . | |
| 5,406,730 | 4/1995 | Sayre . | |
| 5,459,696 | 10/1995 | Dovrat et al. . | |

FOREIGN PATENT DOCUMENTS

| | | |
|---|---|---|
| 0 554 905 | 8/1993 | European Pat. Off. . |
| 39 11 804 | 10/1990 | Germany . |
| 40 22 038 | 1/1992 | Germany . |
| 44 17 545 | 11/1995 | Germany . |
| 42 03 585 | 4/1996 | Germany . |

*Primary Examiner*—Charles T. Jordan
*Assistant Examiner*—Theresa M. Wesson
*Attorney, Agent, or Firm*—Venable; Gabor J. Kelemen

[57] ABSTRACT

A weapon includes a barrel for firing ammunition therefrom; and an apparatus for monitoring firing stresses of the barrel. The apparatus includes a body sound sensor mounted on the weapon and emitting a first signal representing body oscillations of the weapon upon firing; and an electronic evaluating device connected to an output of the sensor. The electronic evaluating device includes a comparator for comparing measuring signals, representing the first signals, with reference signals representing different charges and for emitting second signals representing results of the comparison; and a non-volatile memory operatively connected to the comparator for additively receiving the second signals and for releasing, on demand, the number of firings and information on an accumulated firing stress of the barrel.

7 Claims, 2 Drawing Sheets

APPARATUS FOR MONITORING THE FIRING STRESS OF A WEAPON BARREL

BACKGROUND OF THE INVENTION

This invention relates to an apparatus for monitoring the firing stress of a weapon barrel.

The barrels of particularly large-caliber weapons have to be replaced for safety reasons after firing a predetermined number of rounds. For this purpose a "barrel log" must be maintained in which the number of rounds fired from the barrel and the respective charge type (if different charges are used for the barrel) have to be entered. Conventionally, the entries have been made in the barrel log manually.

SUMMARY OF THE INVENTION

It is an object of the invention to provide an apparatus with which an accurate, automatic and simple monitoring of the firing stress of the weapon barrel is made possible.

This object and others to become apparent as the specification progresses, are accomplished by the invention, according to which, briefly stated, the weapon includes a barrel for firing ammunition therefrom and an apparatus for monitoring firing stresses of the barrel. The apparatus includes a body sound sensor mounted on the weapon and emitting a first signal representing body oscillations of the weapon upon firing; and an electronic evaluating device connected to an output of the sensor. The electronic evaluating device includes a comparator for comparing measuring signals, representing the first signals, with reference signals representing different charges and for emitting second signals representing results of the comparison; and a non-volatile memory operatively connected to the comparator for additively receiving the second signals and for releasing, on demand, the number of firings and information on an accumulated firing stress of the barrel.

The invention is essentially based on the principle to measure, with a suitable sensor, the actual body sound signals (body oscillations) obtained upon the firing of the weapon and to compare the signals in an electronic evaluating apparatus with reference signals which characterize the different charges and which are stored in a memory. The charge value which is associated with the actual signal value and which is obtained from such a comparison is subsequently stored in a non-volatile memory of the evaluating apparatus and is added to an already stored charge value. The same applies to the number of shots measured by the sensor.

The apparatus according to the invention has, among others, the advantage that even in large-caliber weapons in which charges of different power are used, the accumulated firing stress may be automatically and very accurately determined and may be at any time retrieved from the memory (electronic barrel log). Further, the apparatus may serve as a counter of fired rounds. Also, the apparatus may be utilized for determining the barrel condition because a change of the barrel condition leads to a characteristic change of the frequency spectrum of the measuring signal.

Further, the apparatus according to the invention is particularly well adapted for verifying the loading condition (that is, loaded or empty state) of a front loading weapon because in the frequency spectrum of the measuring signal of the body sound sensor a signal value may be measured which is characteristic of the impacting of the cartridge on the firing pin or the weapon breechblock, as the case may be. By obtaining such a measuring value by evaluation, to thus indicate a loaded state of the weapon, a loading of a second cartridge on top of the first cartridge may be prevented by an actuated warning signal or a barrel lock.

DESCRIPTION OF THE PREFERRED EMBODIMENT

Figure 1:
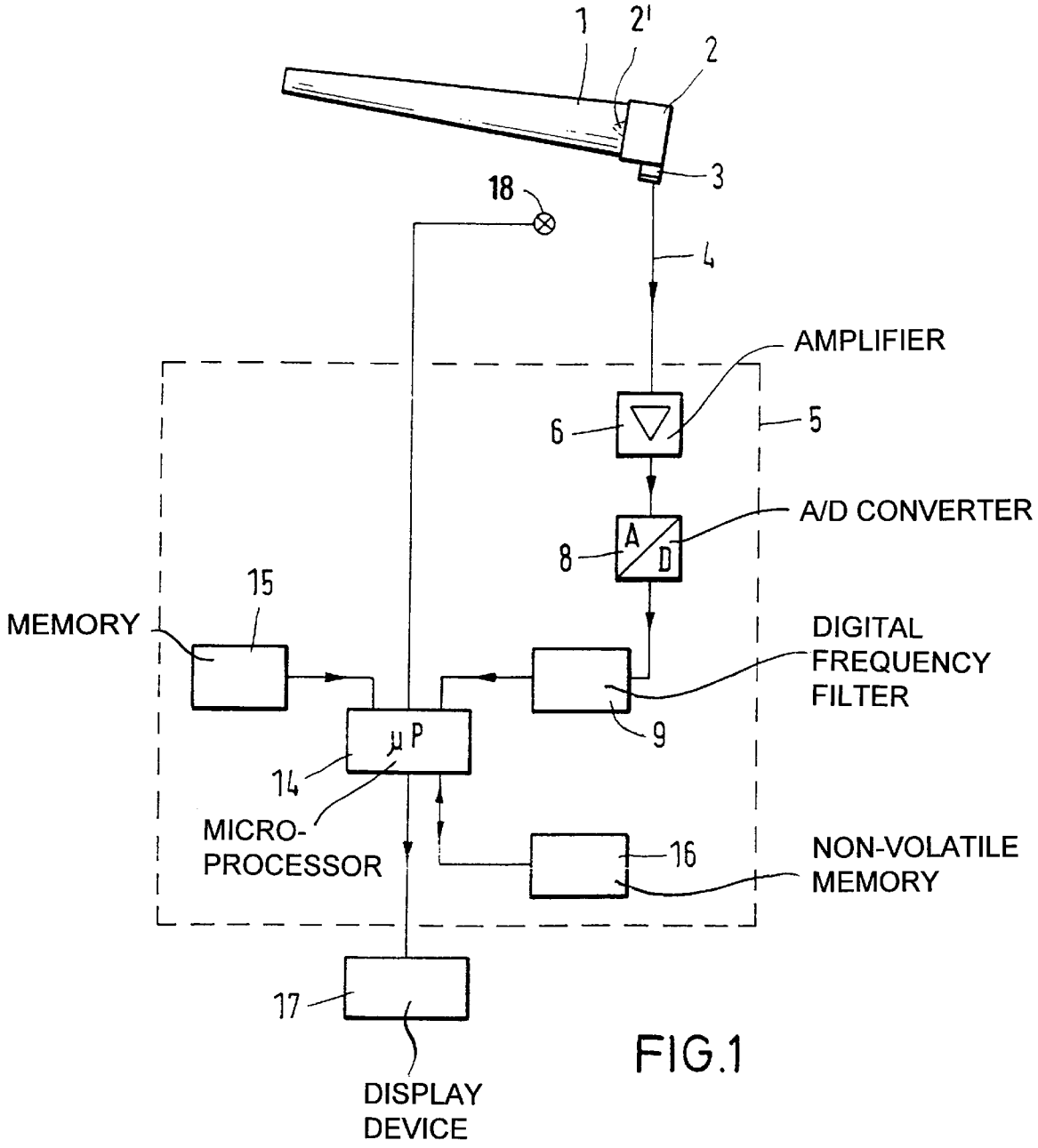
FIG. 1 shows a weapon barrel, a body sound sensor arranged at the breechblock and a block diagram of an evaluating device with which the sensor is connected.

FIG. 1 shows a weapon barrel 1 of a front loading weapon such as a mortar. The barrel 1 has a breechblock 2 provided with a firing pin 2'. A piezoelectric acceleration sensor 3 is mounted on the breechblock 2 for measuring the body sound oscillations generated when a round is fired. The acceleration sensor 3 is connected by a conductor 4 to an electronic evaluating apparatus 5.

Figure 2:
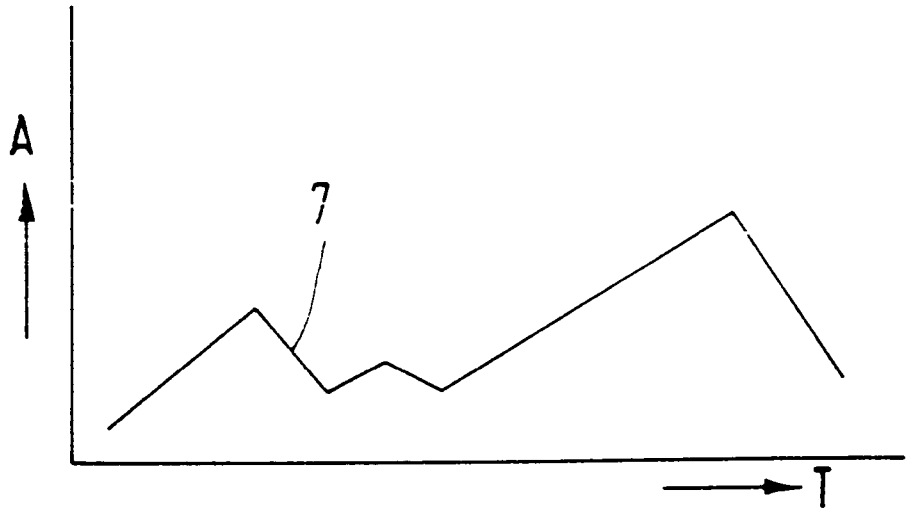
FIG. 2 is a diagram illustrating a sensor signal as a function of time.

The evaluating apparatus 5 has an input amplifier 6 for amplifying the signals generated by the sensor 3. The amplified signal 7 (FIG. 2) is applied to an analog/digital converter 8 connected to an output of the amplifier 6 and is digitalized therein and then applied to a digital frequency filter 9.

Figure 3:
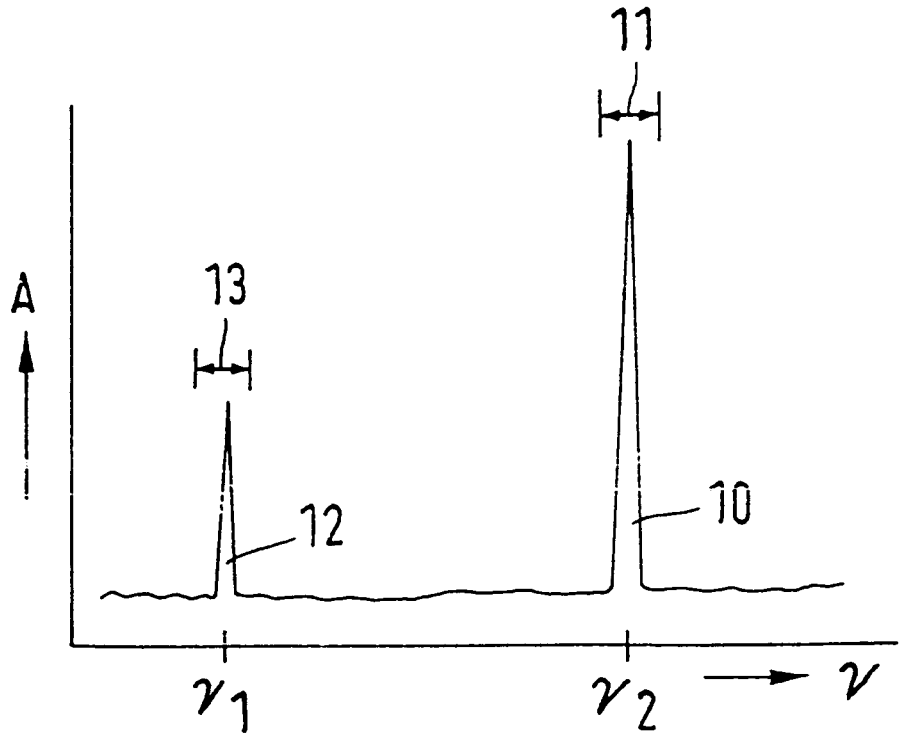
FIG. 3 is a diagram illustrating an idealized frequency spectrum corresponding to the sensor signal illustrated in FIG. 2.

The frequency range of the digital filter 9 is selected such that only those frequency components of the measuring signal 7 are passed which are characteristic of the firing stress of the barrel or those which appear during the loading operation when the cartridge, as it descends in the barrel, impacts on the breechblock or the firing pin. FIG. 3, showing a coordinate system having an amplitude ordinate A and a frequency abscissa $\gamma$, illustrates the signal value 10 of the frequency spectrum characteristic of the firing stress and the frequency zone 11 to be analyzed. The signal value 10 has a peak at the frequency $\gamma_1$. The signal value 12 is characteristic of the impact of a cartridge on the breechblock 2, and the corresponding frequency range to be analyzed is designated at 13. The signal value 12 has a peak at the frequency $\gamma_2$.

The digital signal values obtained at the frequency filter 9 are thereafter inputted in the working memory of a microprocessor 14 and compared with characteristic reference signals which the microprocessor 14 retrieves from a memory 15. These reference signals have been first predetermined preferably with a weapon of the same type while using different charges and applied to the memory 15.

After determining the charge value corresponding to the measured signal value, the charge value is inputted in a non-volatile memory 16 or, if a corresponding value is already stored there, the charge value is added thereto. At the same time, the value corresponding to the number of rounds fired is accordingly increased in the memory.

If desired, a weapon inspector may subsequently verify on a display 17 both the number of fired rounds and the accumulated firing stress of the barrel.

If the signal value 12 of the frequency spectrum is also to be utilized to prevent an accidental loading of an already-loaded barrel, the microprocessor 14, upon determining the presence of signal 12, actuates a lamp 18 which indicates to the weapon crew that ammunition is already present in the weapon barrel 1.

It is to be understood that the invention is not limited to the above-described exemplary embodiment. For example, the digital frequency filter 9 may be replaced by an analog filter in the evaluating apparatus 5. Also, the frequency filter may be composed of a plurality of partial filters which have their greatest sensitivity in different frequency ranges. For example, a first partial filter may have its greatest sensitivity in the frequency range 11 whereas a second partial filter may have its greatest sensitivity in the frequency range 13.

As an alternative, the body sound sensor 3 may be mounted on the barrel rather than on the breechblock. Furthermore, two or more sensors may be arranged on the weapon barrel or the breechblock. For example, one sensor may be arranged on the breechblock to determine the impacting of a cartridge on the firing pin during the loading operation, while another sensor may be arranged on the barrel for determining the firing stress during firing. It is further feasible to provide the evaluating device 5 with a second frequency filter which passes solely those frequency components of the measuring signal which are characteristic of a terminal position of the breechblock upon opening or closing thereof.

It will be understood that the above description of the present invention is susceptible to various modifications, changes and adaptations, and the same are intended to be comprehended within the meaning and range of equivalents of the appended claims.

What is claimed is:

1. A weapon comprising (a) a barrel for firing ammunition therefrom; and (b) an apparatus for monitoring firing stresses of the barrel; said apparatus including (1) a body sound sensor mounted on the weapon and emitting a first signal representing body oscillations of said weapon upon firing; and (2) an electronic evaluating device connected to an output of the sensor and including (i) comparator means for comparing measuring signals, representing said first signal, with reference signals representing different charges and for emitting second signals representing results of the comparison; and (ii) a non-volatile memory operatively connected to said comparator means for additively receiving said second signals and for releasing the number of firings and information on an accumulated firing stress of the barrel.

2. The weapon as defined in claim 1, wherein said sensor is mounted on the barrel.

3. The weapon as defined in claim 1, wherein said barrel includes a breechblock and further wherein said sensor is mounted on said breechblock.

4. The weapon as defined in claim 1, wherein said sensor comprises a piezoelectric acceleration sensor.

5. The weapon as defined in claim 1, wherein said evaluating device comprises a frequency filter passing solely such frequency components of said measuring signals which are indicative of firing stresses of said barrel.

6. The weapon as defined in claim 5, wherein said frequency filter is a first frequency filter; further wherein said weapon is a front loading weapon; said barrel having a breechblock provided with a firing pin; further wherein said evaluating device comprises a second frequency filter passing solely such frequency components of said measuring signal which are indicative of an impacting of a cartridge on one of said breechblock and said firing pin upon loading said cartridge in said barrel.

7. The weapon as defined in claim 5, wherein said frequency filter is a first frequency filter and said barrel has an openable and closable breechblock; further wherein said evaluating device comprises a second frequency filter passing solely such frequency components of said measuring signal which are indicative of a terminal position of said breechblock upon opening or closing thereof.

* * * * *